US009409202B2

(12) United States Patent
Nespoli

(10) Patent No.: US 9,409,202 B2
(45) Date of Patent: Aug. 9, 2016

(54) PAINT ROLLER

(71) Applicant: NESPOLI GROUP SPA, Vighizzolo di Cantù (IT)

(72) Inventor: Alessandro Nespoli, Dinkelsbuehl (DE)

(73) Assignee: NESPOLI GROUP SPA, Vighizzolo di Cantù (IT)

( * ) Notice: Subject to any disclaimer, the term of this patent is extended or adjusted under 35 U.S.C. 154(b) by 0 days.

(21) Appl. No.: 14/771,660

(22) PCT Filed: Jun. 20, 2013

(86) PCT No.: PCT/EP2013/062896
§ 371 (c)(1),
(2) Date: Aug. 31, 2015

(87) PCT Pub. No.: WO2014/135227
PCT Pub. Date: Sep. 12, 2014

(65) Prior Publication Data

US 2016/0001318 A1 Jan. 7, 2016

(30) Foreign Application Priority Data

Mar. 4, 2013 (EP) ..... PCT/EP2013/054295

(51) Int. Cl.
*B05C 17/02* (2006.01)

(52) U.S. Cl.
CPC ..... *B05C 17/0205* (2013.01); *B05C 17/02* (2013.01)

(58) Field of Classification Search
CPC ..... B05C 17/02; B05C 17/0205
See application file for complete search history.

(56) References Cited

U.S. PATENT DOCUMENTS

| | | | | |
|---|---|---|---|---|
| 3,102,327 | A | 9/1963 | Wiegand | |
| 3,711,887 | A * | 1/1973 | Chapman | B05C 17/02 15/230.11 |
| 5,345,648 | A | 9/1994 | Graves | |
| 2004/0151060 | A1 * | 8/2004 | Hutchinson | B01F 7/001 366/129 |
| 2004/0181893 | A1 * | 9/2004 | Martin | B05C 17/02 15/230.11 |
| 2004/0205921 | A1 | 10/2004 | Woodruff et al. | |

FOREIGN PATENT DOCUMENTS

| | | | |
|---|---|---|---|
| DE | 3410468 | A1 | 9/1985 |
| EP | 0 672 463 | A1 | 9/1995 |
| WO | 00/37184 | A1 | 6/2000 |

OTHER PUBLICATIONS

PCT, "International Search Report for International Application No. PCT/EP2013/062896",(2013).

* cited by examiner

*Primary Examiner* — Randall Chin
(74) *Attorney, Agent, or Firm* — Manabu Kanesaka

(57) ABSTRACT

A paint roller includes a paint roll and bracket having at its one end a handle and on its other end an end portion where the paint roll can be connected rotatably, and at the end portion there is provided a snap element, wherein a counter-snap element, which corresponds to the snap element, is provided at a first end of a paint roll tube of the paint roll. A spring for urging the snap element and the counter-snap element apart when moving the snap element in direction of the counter-snap element is provided. The spring, snap element and counter-snap element act together such that the snap element engages the counter-snap element when pushing the snap element against the elastic force, and the snap element disengages from the counter-snap element when subsequently pushing the snap element against the elastic force so that the paint roll can be disconnected from the bracket.

22 Claims, 17 Drawing Sheets

Figures 1, 2, 3:
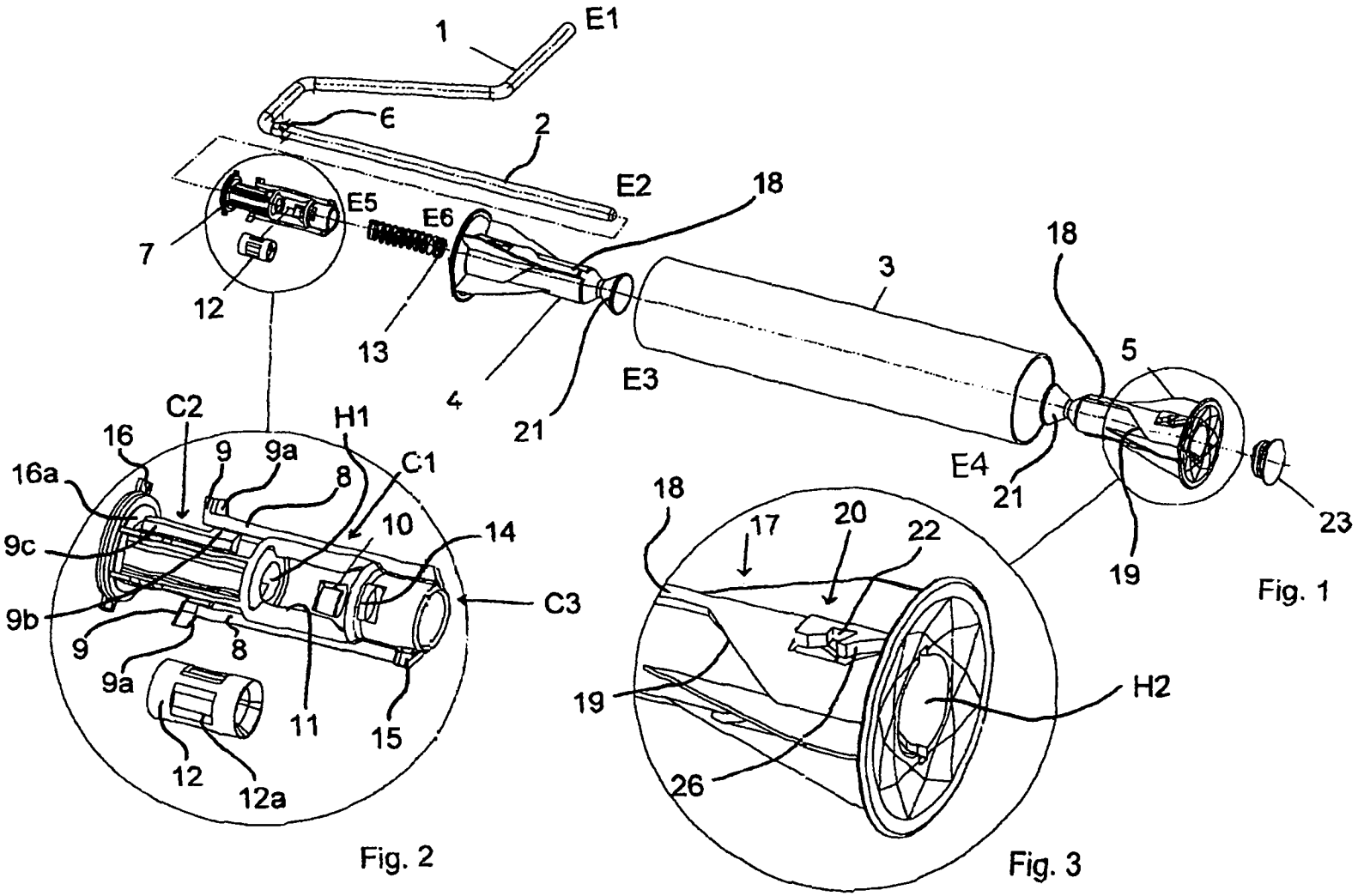

E1
1
2
E2
E
E5
E6
7
12
13
18
4
21
E3
3
E4
21
18
5
19
23

H2
22
20
17
18
19
26

C3
14
15
C1
10
H1
8
11
9a
9
C2
16
16a
9c
9b
9
9a
8
12a
12

E1
47
1
6
2
13
51
44
48
46
49
50a
50b
E9
45

57
58
59
54

59
58
56
57
19
55
53
52
54

B
B 59
58
57
52
54
26

19
58
55
19

19
58
55
54
56
52
57

PAINT ROLLER

RELATED APPLICATIONS

The present application is National Phase of International Application No. PCT/EP2013/062896 filed Jun. 20, 2013, and claims priority from International Application No. PCT/EP2013/054295, filed Mar. 4, 2013, the disclosure of which is hereby incorporated by reference herein in its entirety.

The present invention relates to a paint roller for applying a paint to a surface, in particular a flat surface, like a wall, a ceiling or the like.

A paint roller is disclosed in EP 0 672 463 A1.

A further paint roller is described in DE 34 10 468 A1. There the paint roller has a bracket with a handle on its one end. On another end of the bracket which runs perpendicular to the direction of the handle there is held rotatably a paint roll. A bearing for rotatably supporting the paint roll comprises a sleeve which is held rotatably within a tube provided inside the paint roll. The other end of the bracket is inserted in the sleeve and held by frictional forces.

U.S. Pat. No. 3,102,327 discloses a paint roller in which the other end of the bracket or spindle, respectively, is fixed by a retaining cap which is mounted at the free end of the spindle.

The known paint rollers have the disadvantage that a disassembly of the bracket and the paint roll is inconvenient. In order to disassemble the paint roll from the bracket it is necessary to hold the paint roll with one hand and to pull the bracket in axial direction with the other hand. Thereby one or both hands are polluted with paint.

In order to provide the conventional paint roller with paint the paint roll is moved along a grid to the surface of a paint until it partly dips into the paint. In order to evenly provide the whole surface of the paint roll with more or less the same amount of paint this act is repeated several times. However, when lifting a paint roll just being partly provided with paint from the grid it occurs that the paint roll spontaneously rotates following gravity in a position where the section of the paint roll being provided with the paint faces the floor. This makes it cumbersome to evenly cover the paint roll with paint.

It is an object of the present invention to solve the disadvantages in the art. It is in particular an object of the present invention to provide a paint roller which can be easily disassembled. According to a further goal of the invention an even provision of paint to the paint roll should be facilitated.

This object is solved by the features of the present invention. Embodiments are described by the features of the present invention.

According to the present invention it is proposed that a push-push mechanism is provided by which the bracket and the paint roll can be connected and disconnected.

Push-push mechanisms are conventionally known, e. g. in the field of ball-pens. The proposed provision of a push-push mechanism has the advantage that the paint roll can be disconnected from the bracket by simply placing a free top surface of the paint roll on the ground and then pushing the bracket into the direction to the ground, so that the push-push mechanism is unlocked and the bracket can be extracted from the paint roll. —In other words, the push-push mechanism is advantageously embodied such that the connection and the disconnection is achieved by pushing the bracket in a pushing-direction which is parallel to an extension direction of the end portion and which is directed towards a free end of the paint roller, the free end being the end opposite to another end in which the end portion of the bracket is inserted. The extension direction of the end portion usually defines the rotational axis of the paint roll. In accordance with the invention it is therefore not necessary to hold the paint roll with a hand in order to disconnect it from the bracket. The proposed invention allows an easy and convenient change of a paint roll.

According to an embodiment of the invention there is provided at the end portion a snap element. There may further be provided a counter-snap element, which corresponds to the snap element, at a first end of a paint roll tube of the paint roll, and spring means for producing an elastic force urging the snap element and the counter-snap element apart when moving the snap element in direction of the counter-snap element are provided, wherein the spring means, the snap element and the counter-snap element act together such that the snap element engages with the counter-snap element when pushing the snap element against the elastic force in direction of the counter-snap element, and the snap element disengages from the counter-snap element when subsequently pushing the snap element against the elastic force in direction of the counter-snap element so that the paint roll can be disconnected from the bracket.

According to an advantageous embodiment the snap element is supported rotatable on the bracket between a first and a second stop limiting an axial movement of the snap element.

According to a further advantageous embodiment the elastic force exerted by the spring means upon the snap element and the counter-snap element holds the snap element in an engaged position with respect to the counter-snap element. However, when pushing the snap element from the engaged position in direction to the counter-snap element disengagement results and the snap element can be axially retracted from the counter-snap element.

The snap element and the counter-snap element may be formed such that they cannot be rotated against each other in the engaged state. In order to achieve this, the snap element may be provided at its outer circumference with a radial tongue and the counter-snap element may be provided with a groove which corresponds to the radial tongue. This means that in the engaged state a rotation of the paint roll is transferred to the snap element. I. e. the snap element then rotates relative to the end portion of the bracket as well as relative to the sleeve being fixedly held on the end portion.

According to a further advantageous embodiment the sleeve is provided at its surface with several recesses and the snap element is provided with an elastic tongue engaging and disengaging with the recesses when the snap element is rotated around the sleeve. By the interaction of the elastic tongue with the recesses there is provided a friction which acts against a rotation of the paint roll around the end portion of the bracket. By the cooperation of the elastic tongue engaging and disengaging the recesses provided at the sleeve the rotation of the paint roll is hindered intermittently. —It is also possible that a friction acting against a free rotation of the paint roll relative to the bracket is provided by a sealing which seals against the penetration of paint into a space surrounded by the paint roll. Such a sealing may be in particular provided between the end portion of the bracket and the snap element and/or the counter-snap element and/or between the snap element and the counter-snap element.

The aforementioned embodiment according to which a free rotation of the pain toll tube with respect to the bracket is hindered by a device providing a frictional force acting against the rotation of the paint roll tube with respect to the bracket is considered to be an independent invention which can be used in connection with any conventional paint roller. According to a preferred embodiment of this idea the frictional force or the like changes dependent on the angle of rotation.

The counter-snap element may be part of a first end piece being inserted into a first end of the paint roll tube.

The first stop may be formed as radial protrusion at the bracket. In particular there may be formed two opposite radial protrusions extending radially from the bracket. The second stop may be made of a sleeve being fixed on the bracket. Such a sleeve may be made of plastic material. It may be held in frictional engagement on the bracket.

According to a further advantageous embodiment the spring means is supported at the bracket. The spring means may in particular be held at the snap element. By the proposed embodiment most parts of the push-push mechanism are held at the bracket. Consequently, the paint roll forming a working part can be manufactured simply and at low cost.

According to a further embodiment of the invention the push-push mechanism may be constructed alternatively. In accordance with an alternative push-push mechanism at the end portion there is provided a snap arrangement comprising a first and a second cam tube being supported rotatable on the bracket, the first cam tube having at its first end face a plurality of first cams, the first cam tube being supported on the bracket between two stops limiting an axial movement thereof, the second cam tube being rotatable engaged with the first cam tube and having at a second end face a plurality of second cams which engageable with the first cams and which can be rotated with respect to the first cams in a lock position and in an unlock position, wherein in the unlock position there are formed axial grooves running between the cams, said grooves corresponding to axially running tongues being provided at an inner surface at the paint roll tube so that the snap arrangement being in the unlock position can be inserted into the paint roll tube, wherein at the paint roll tube there is provided a third stop, and wherein spring means for producing an elastic force urging the second cams against the first cams are provided, when moving the snap arrangement against the third stop.

The further push-push mechanism is embodied such that the snap arrangement being held on the end portion of the bracket can adopt two different states, namely a locked state and a unlocked state. In the unlocked state it is possible to insert or retract the bracket holding the snap arrangement from the paint roll tube. The snap arrangement is switched from the unlocked state into the locked state when pushing it against the third stop. In the locked stage the snap arrangement is held by the tongues within the paint roll tube. Upon exerting a pressure on the snap arrangement it switches in the unlocked state in which groove sections provided at the first and the second cam tubes come into alignment so that the snap arrangement can be retracted along the tongues from the paint roll tube.

According to an embodiment the first cams have first slanted faces and the second cams have corresponding second slanted faces so that the second cam tube rotates into the lock position when the second cam tube is urged by the spring against the first cam tube and when the second cam tube is out of engagement with the tongues. —This allows for an automatic switching into the locked state when the snap arrangement is pushed into the paint roll tube.

According to a further embodiment the inner surface, the tongues and the third stop are part of a third end piece being inserted into a first end of the paint roll tube.

A second end piece may be inserted into a second end of the paint roll tube. The second end piece may have a further recess for rotatably holding the end portion of the bracket. The further recess may be embodied as a through hole being concentric with the paint roll tube. According to an advantageous embodiment an end cap closing or sealing, respectively, the through hole may be provide at the second end piece.

The first or the third and the second end piece may be constructed identically. They may be made from plastic material by injection molding.

According to a further embodiment of the invention there is proposed a further alternative push-push mechanism comprising a further snap element being provided at the end portion, a further counter-snap element being in engagement with the further snap element such that upon pushing the bracket in the pushing direction the further snap element is moved relative to the further counter-snap element in an axial direction from a first axial position into a second axial position or vice-versa, and a clamping device having a clamping element being actuated by the further snap element such that it changes its radius in dependency of the position of the clamping element. —In the proposed embodiment all elements regarding the push-push mechanism are provided at the bracket. Consequently, the paint roll can be embodied in a simple manner just comprising a paint roll tube having at its outer surface a material being adapted to hold paint. By the push-push mechanism there is actuated a clamping element which changes its radius and can therefore be set in a state in which the paint roll tube surrounding the clamping element is clamped or in a state in which the clamping element has changed its radius such that it can be retracted from the paint roll tube.

According to an embodiment the further snap element is held rotatably upon the end portion. It is held such that an axial movement thereof is limited, i. e. such that a rotation is possible but an axial disengagement is hindered. As the further counter-snap element is in engagement with the further snap element also the further counter-snap element is held rotatably with respect to the end portion of the bracket.

The further counter-snap element comprises advantageously an end cap, and a compression spring may be provided between the end cap and an actuating element being provided at a free end of the snap element. The further snap element has in general a tubular shape extending along the end portion of the bracket. The further counter-snap element has a further tubular shape being embodied such that it surrounds the further snap element. An actuating element is provided nearby an end cap which is connected with the further counter snap element. The actuating element can be moved in axial direction relative to the end cap by the push-push mechanism from a first axial position into a second axial position or vice-versa. By changing the position it is possible to actuate the clamping device such that it is set from a clamping state into a released state or vice-versa.

According to an embodiment the clamping element is a flexible hose extending from the end cap and surrounding the actuating element. In such case the actuating element has a conical shape such that a radius of the hose is changed in dependency of the position of the actuating element. Under the term "conical shape" there is understood in general that an outer diameter of the actuating element decreases in the direction of the end cap. The actuating element may be formed that such just a portion thereof has a conical shape.

A first outer radius of the clamping element corresponding to the first position of the actuating element is advantageously smaller than an inner radius of a paint roll tube, and wherein a second outer radius of the clamping element corresponding to the second position of the actuating element is larger than the inner radius of the paint roll tube. The second outer radius is chosen such that in a clamping state the paint roll tube is held by the hose being compressed in radial direction.

Figure 4:
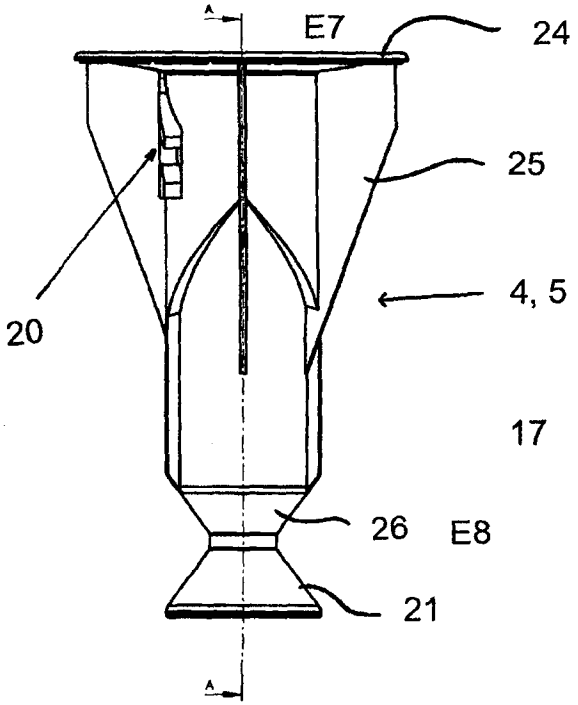
Figure 5:
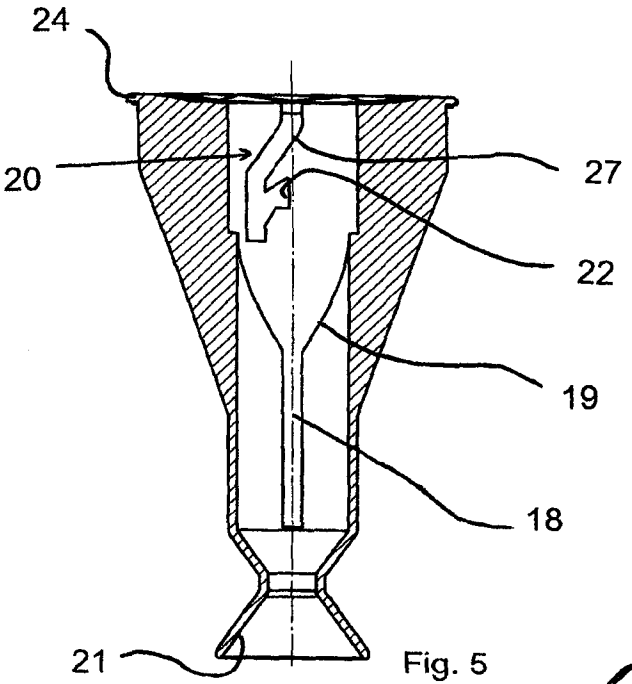
Figure 6:
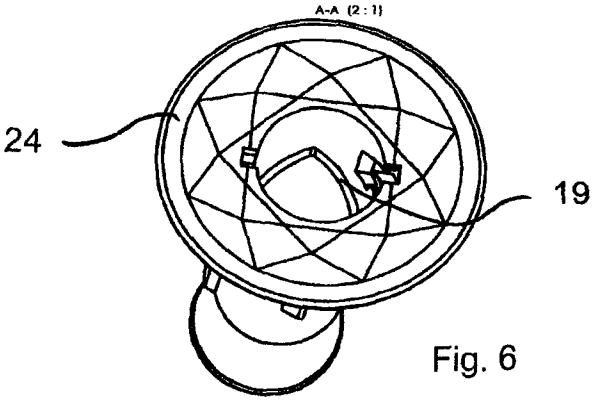
Figure 7:
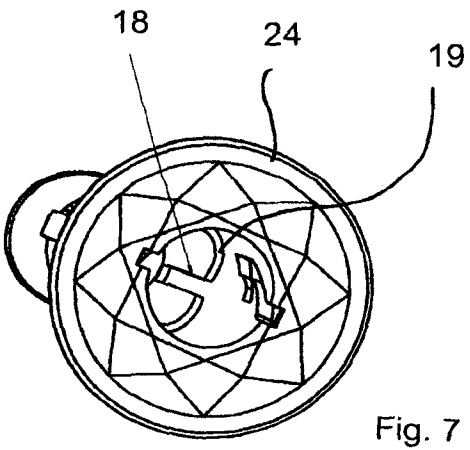
Figure 9:
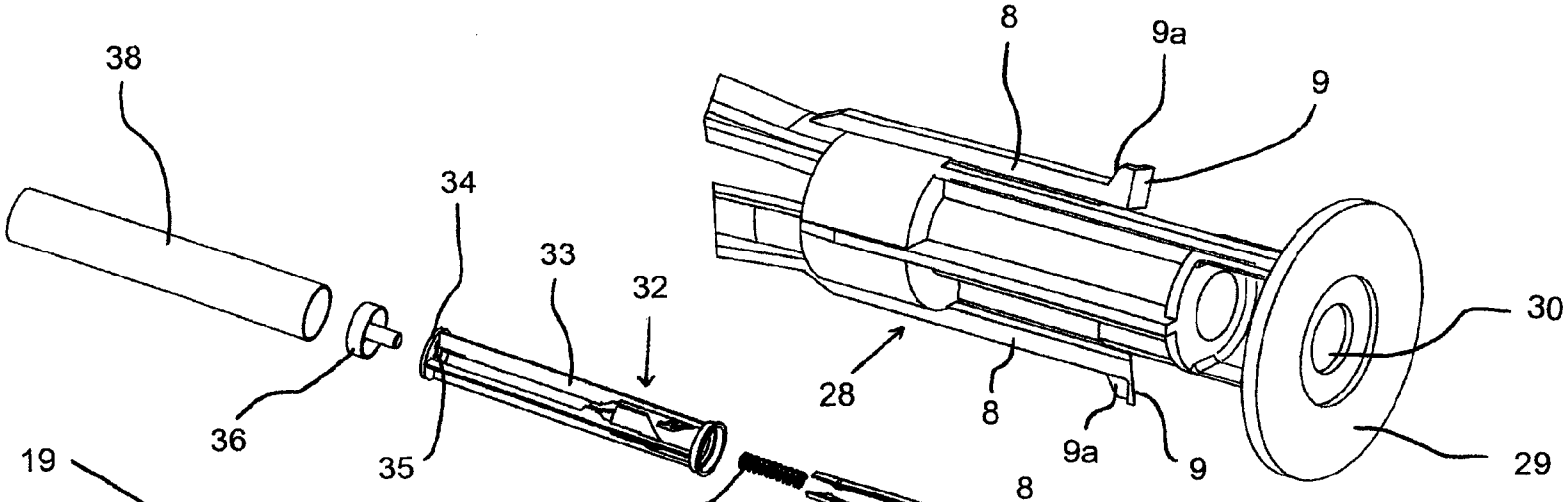
Figure 8:
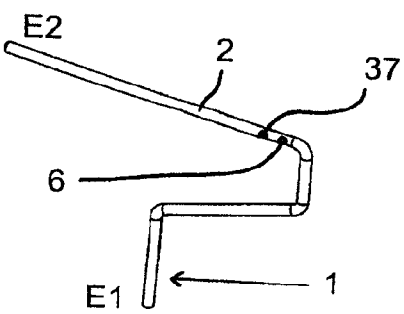
Figure 10:
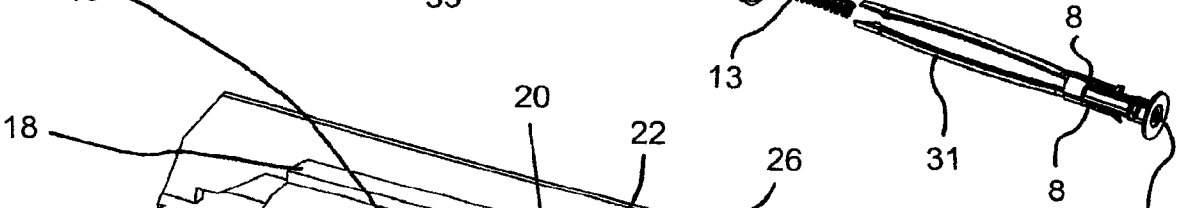
Figure 11:
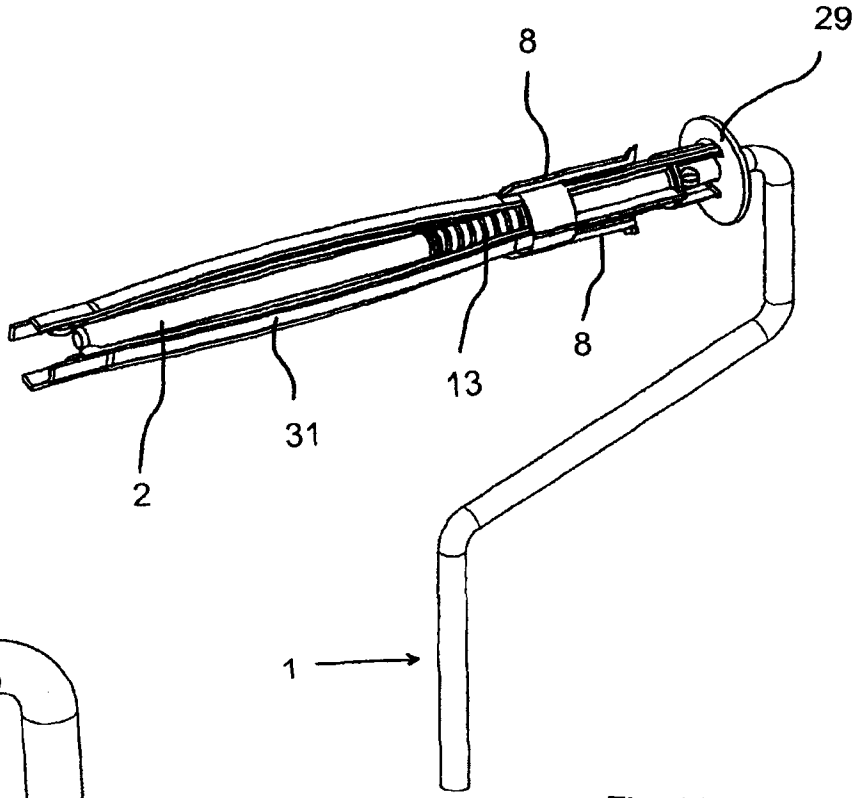
Figure 12:
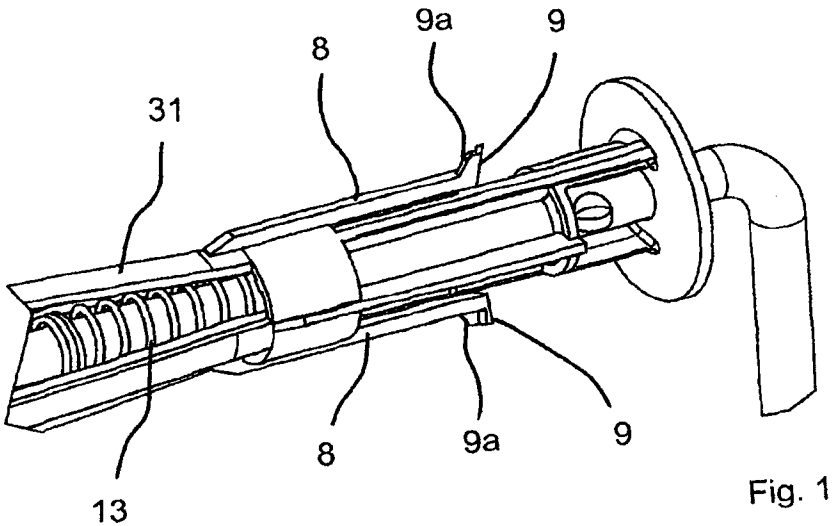
Figure 13:
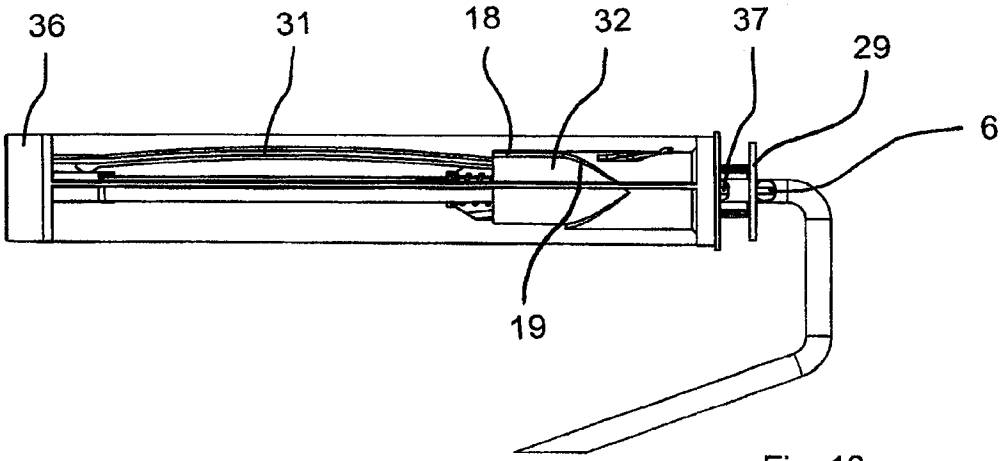
Figure 14:
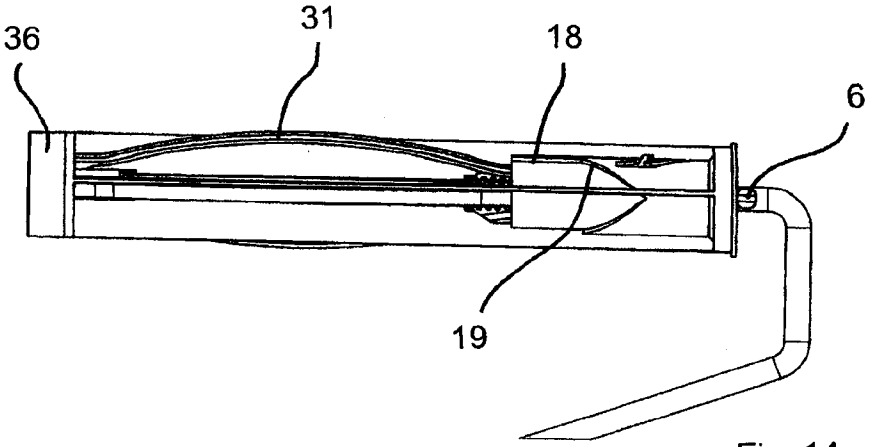
Figures 15, 16, 17:
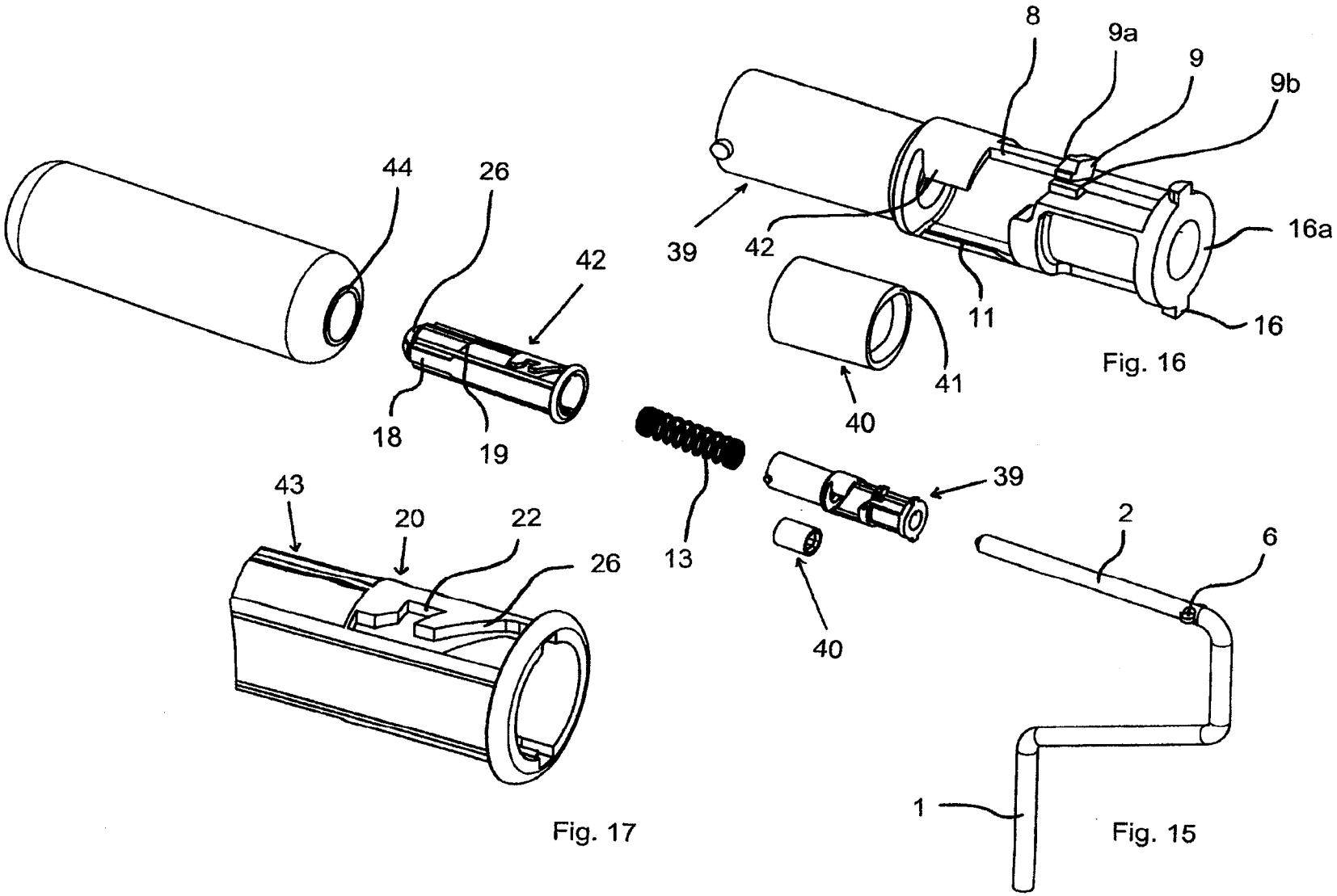
Figure 18:
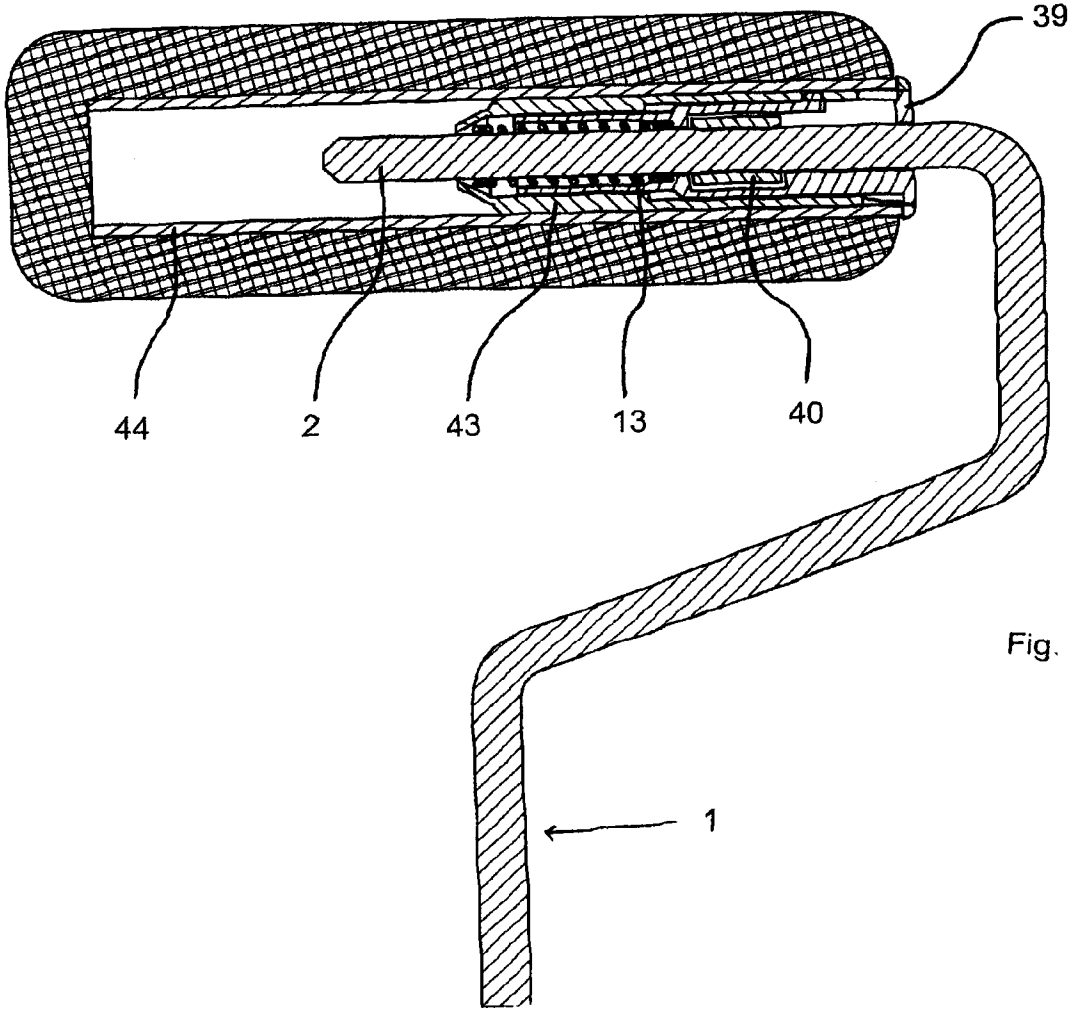
Figures 19, 20, 21:
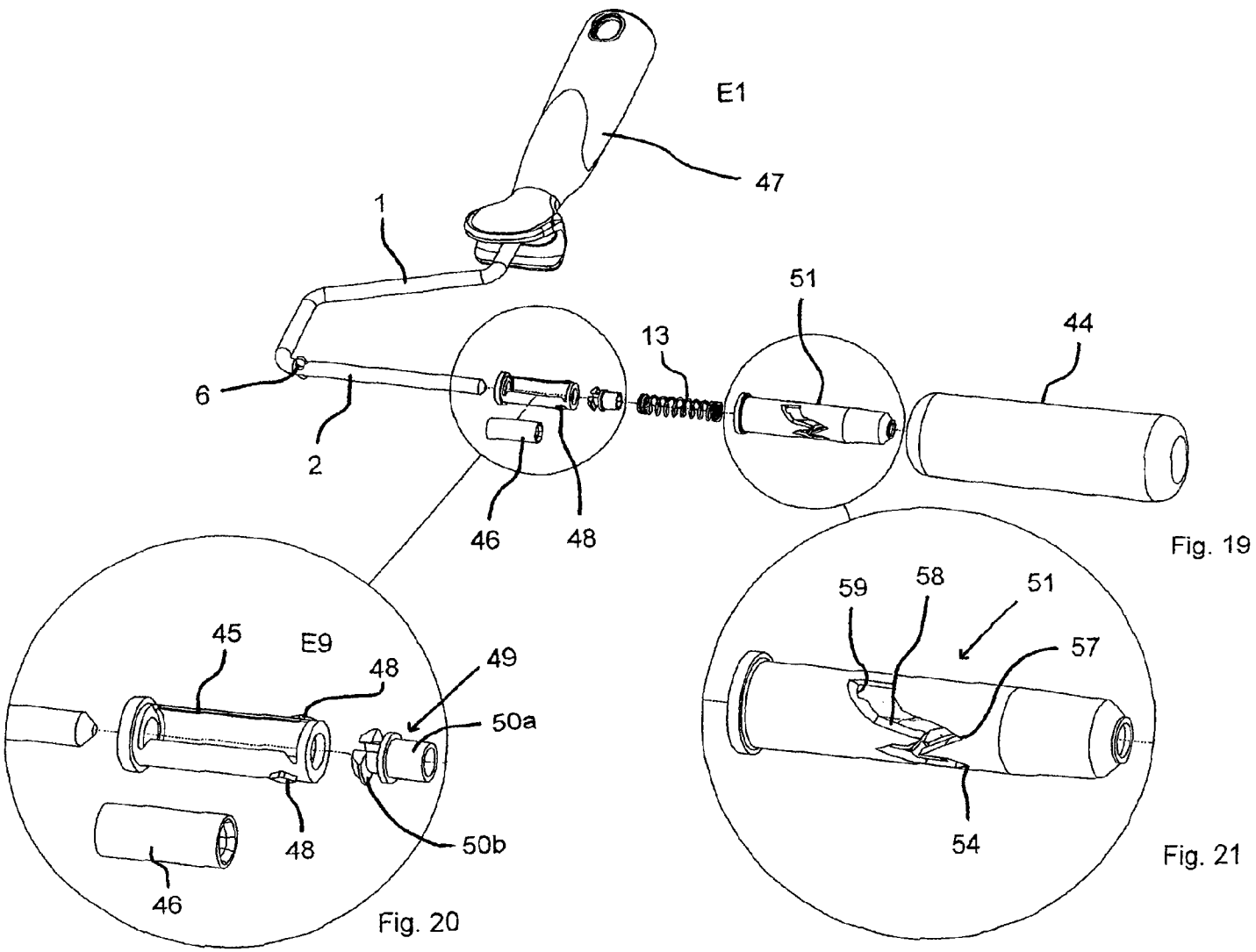
Figures 22, 23, 24, 25, 26:
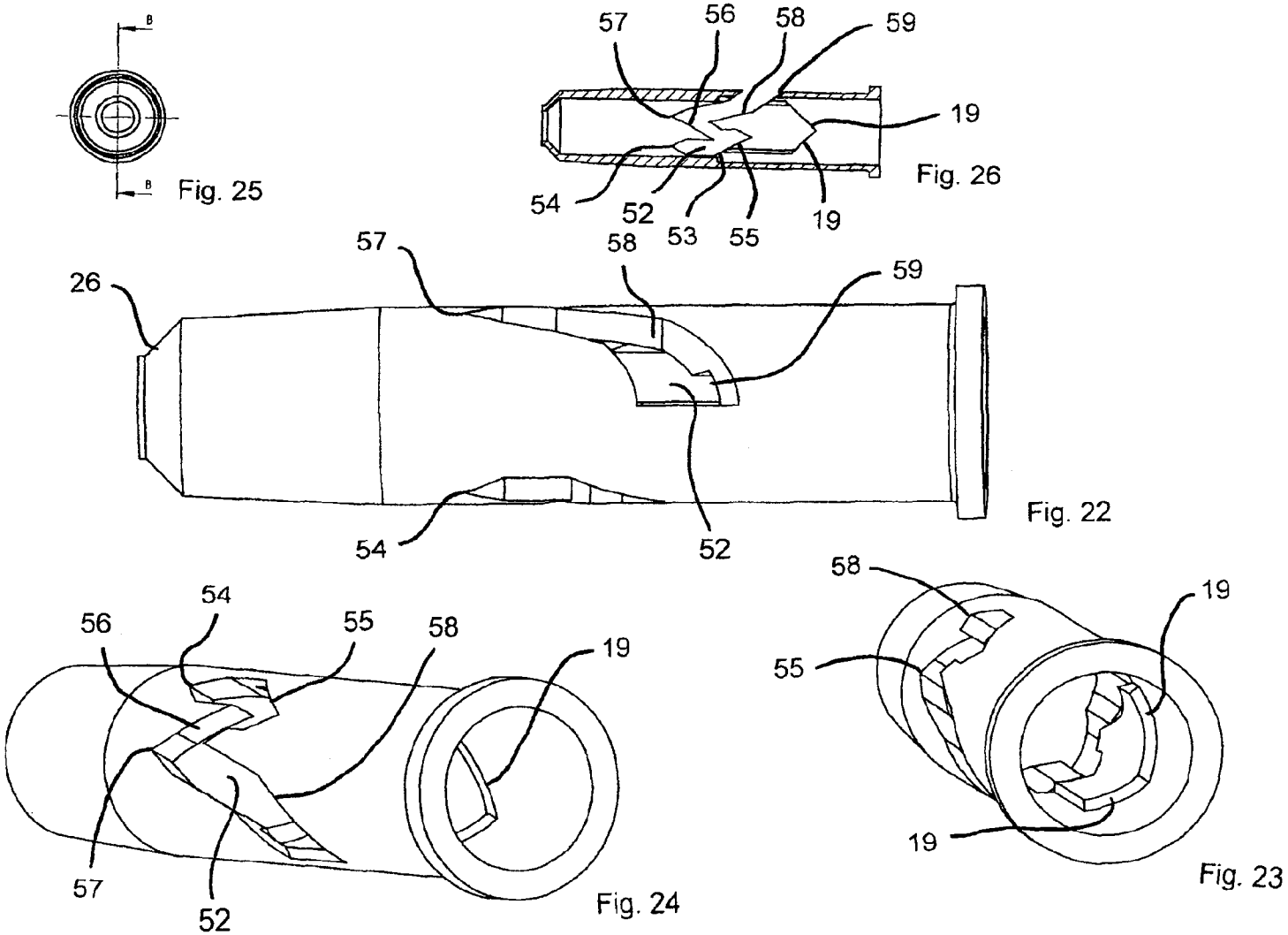
Figure 27:
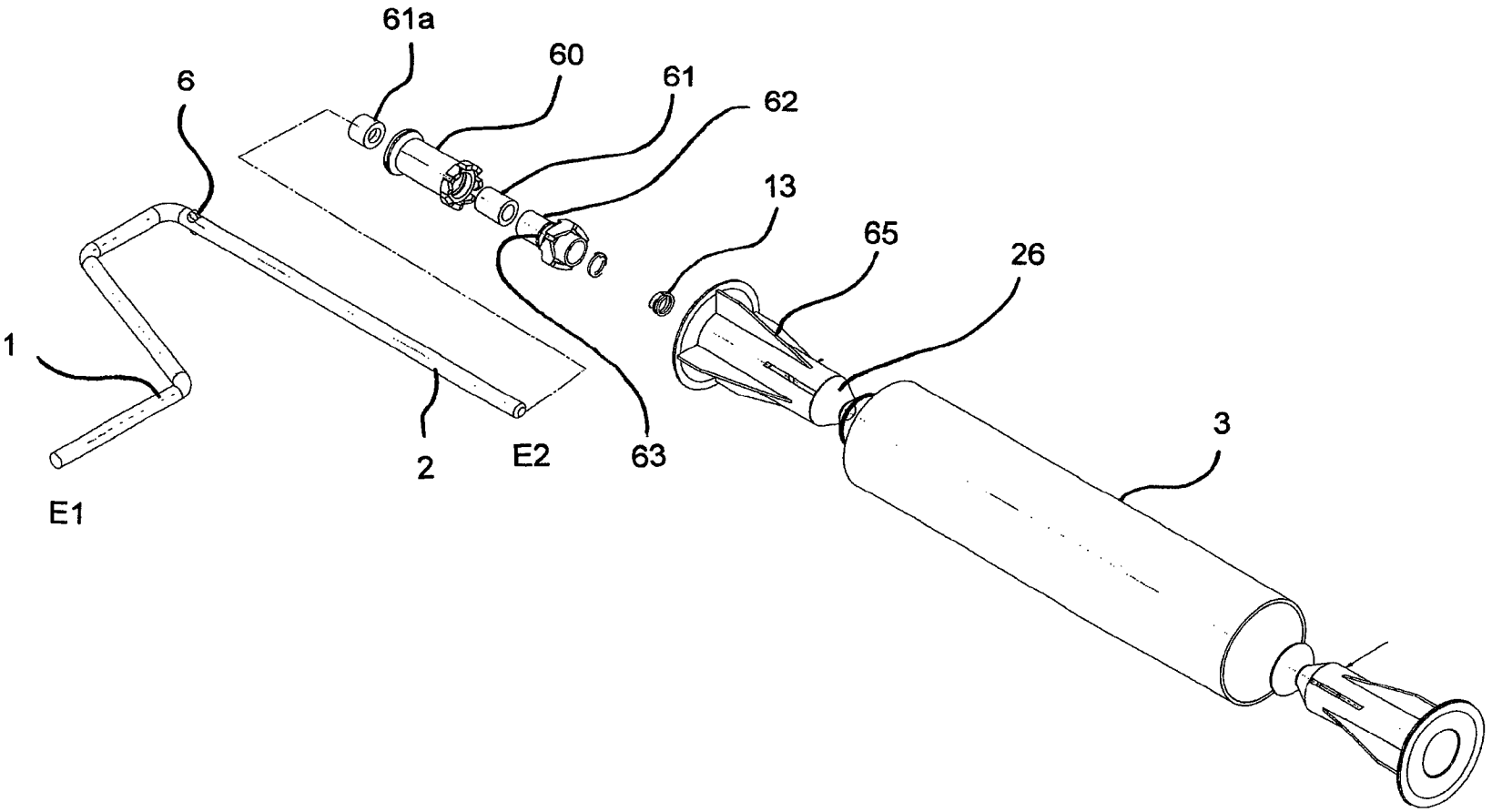
Figure 28:
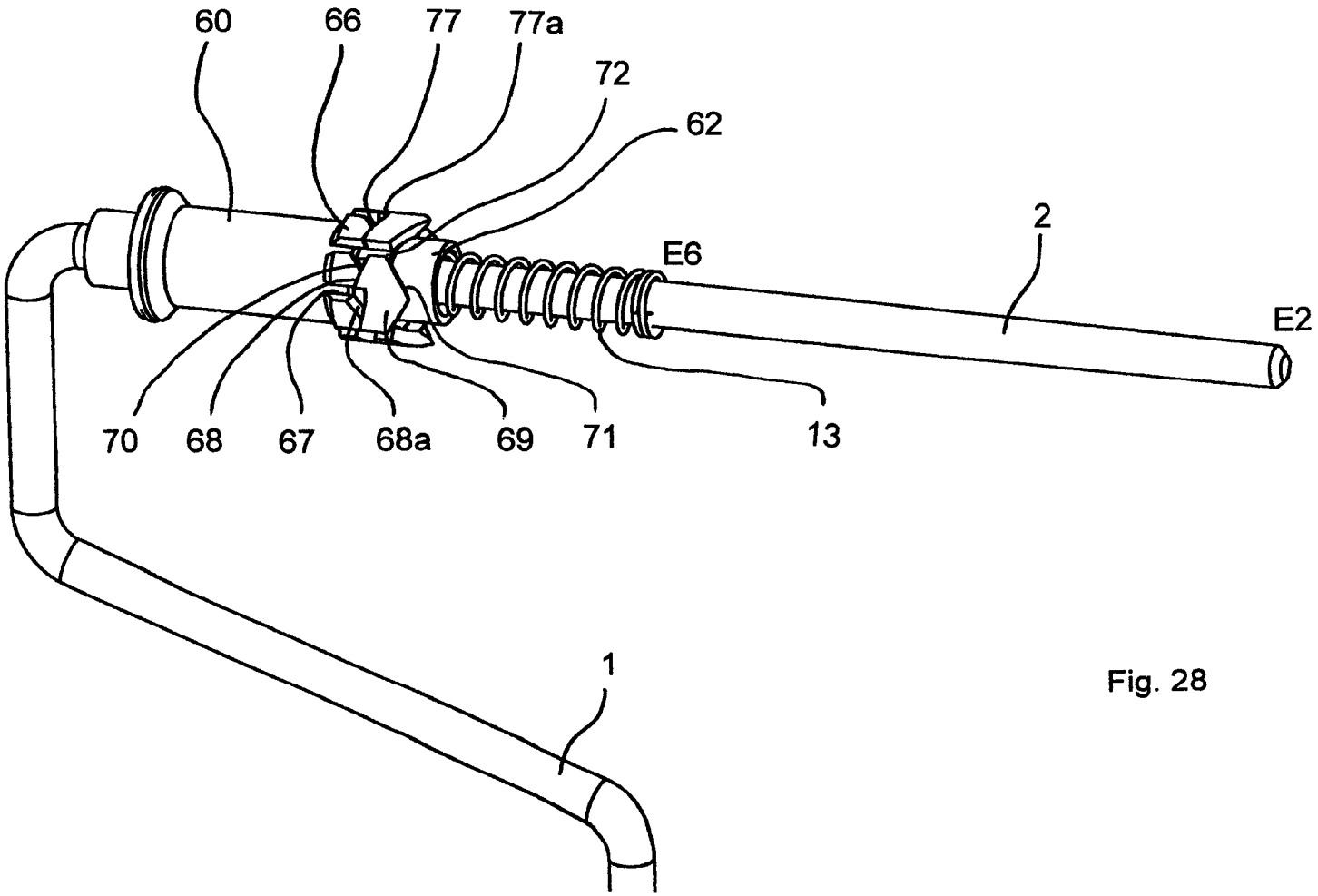
Figure 29:
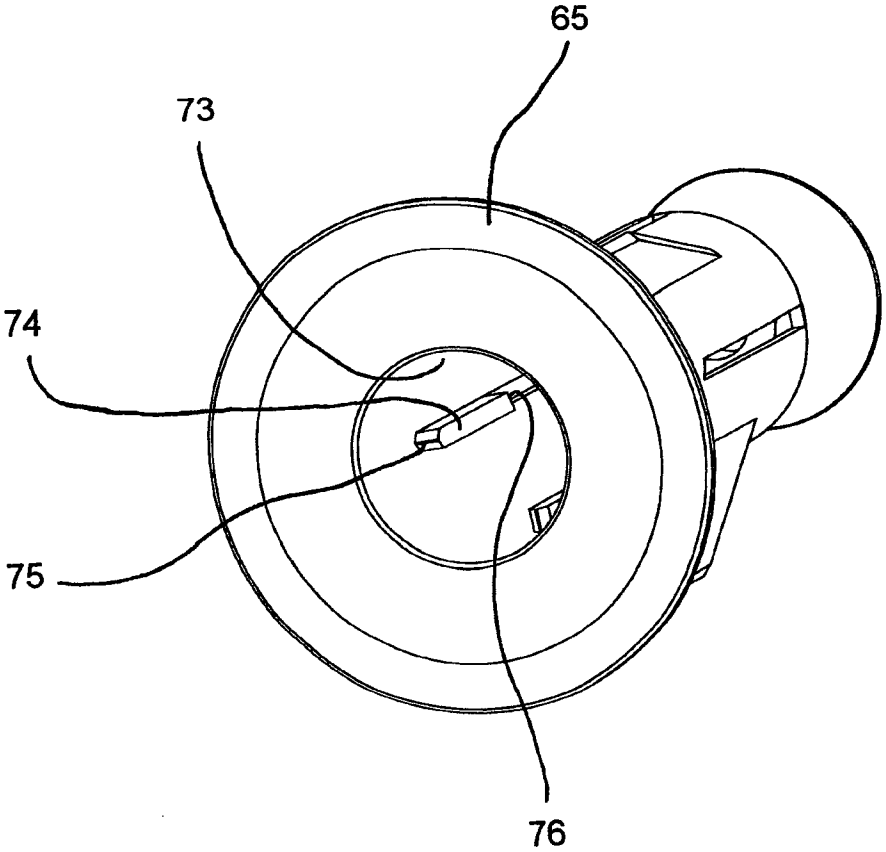
Figure 30:
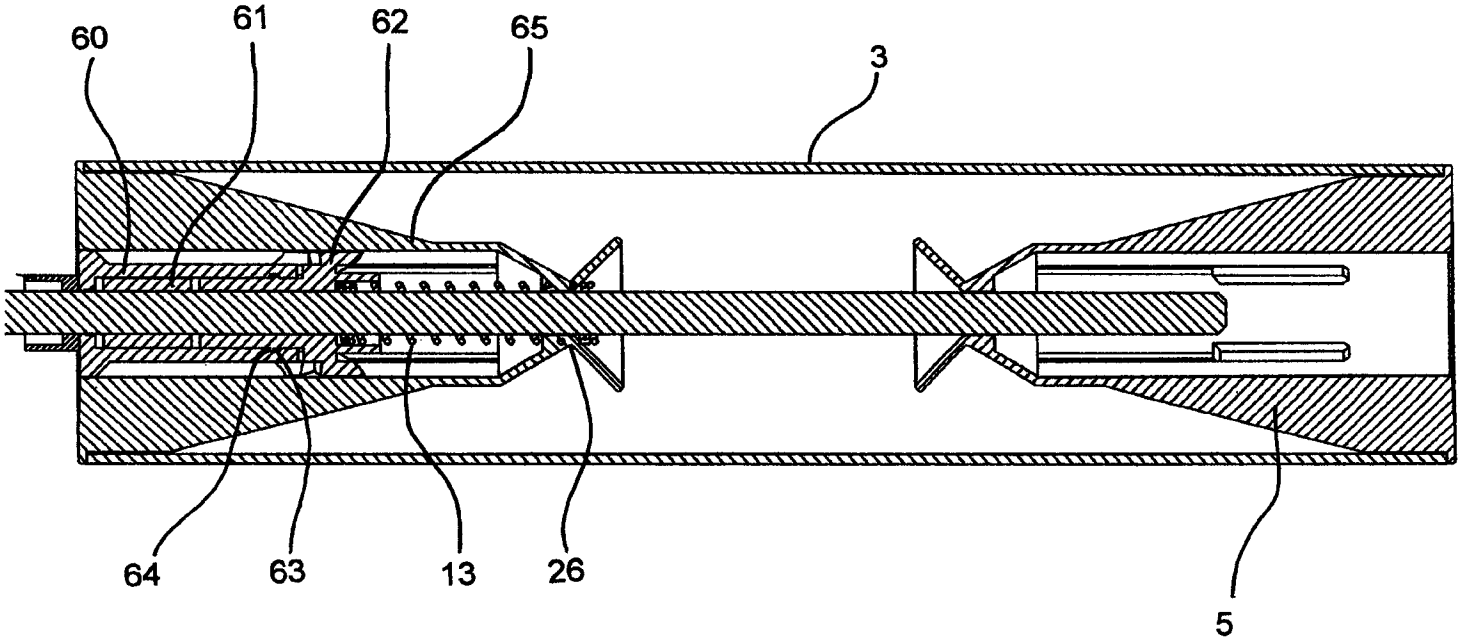
Figure 31:
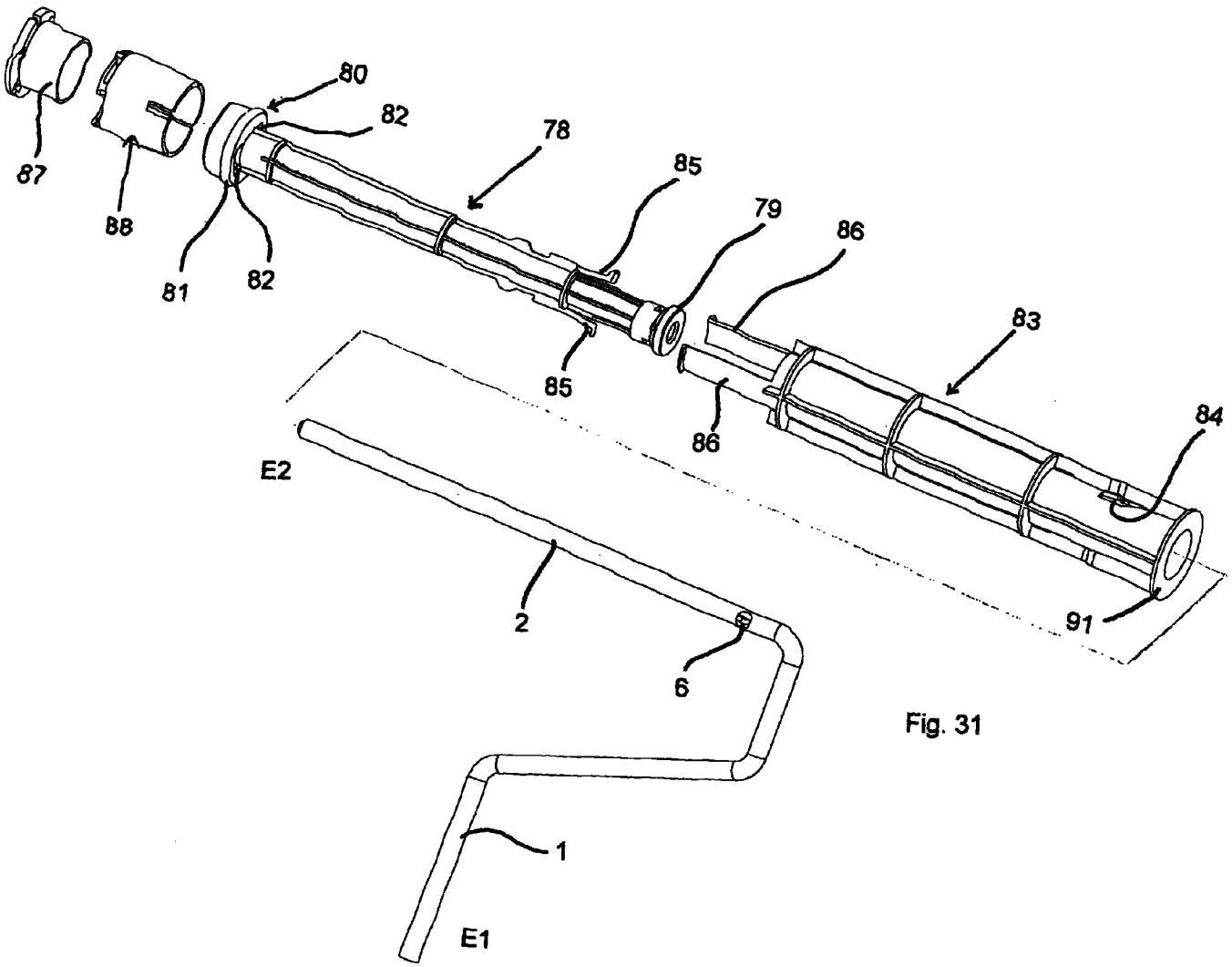
Figure 32:
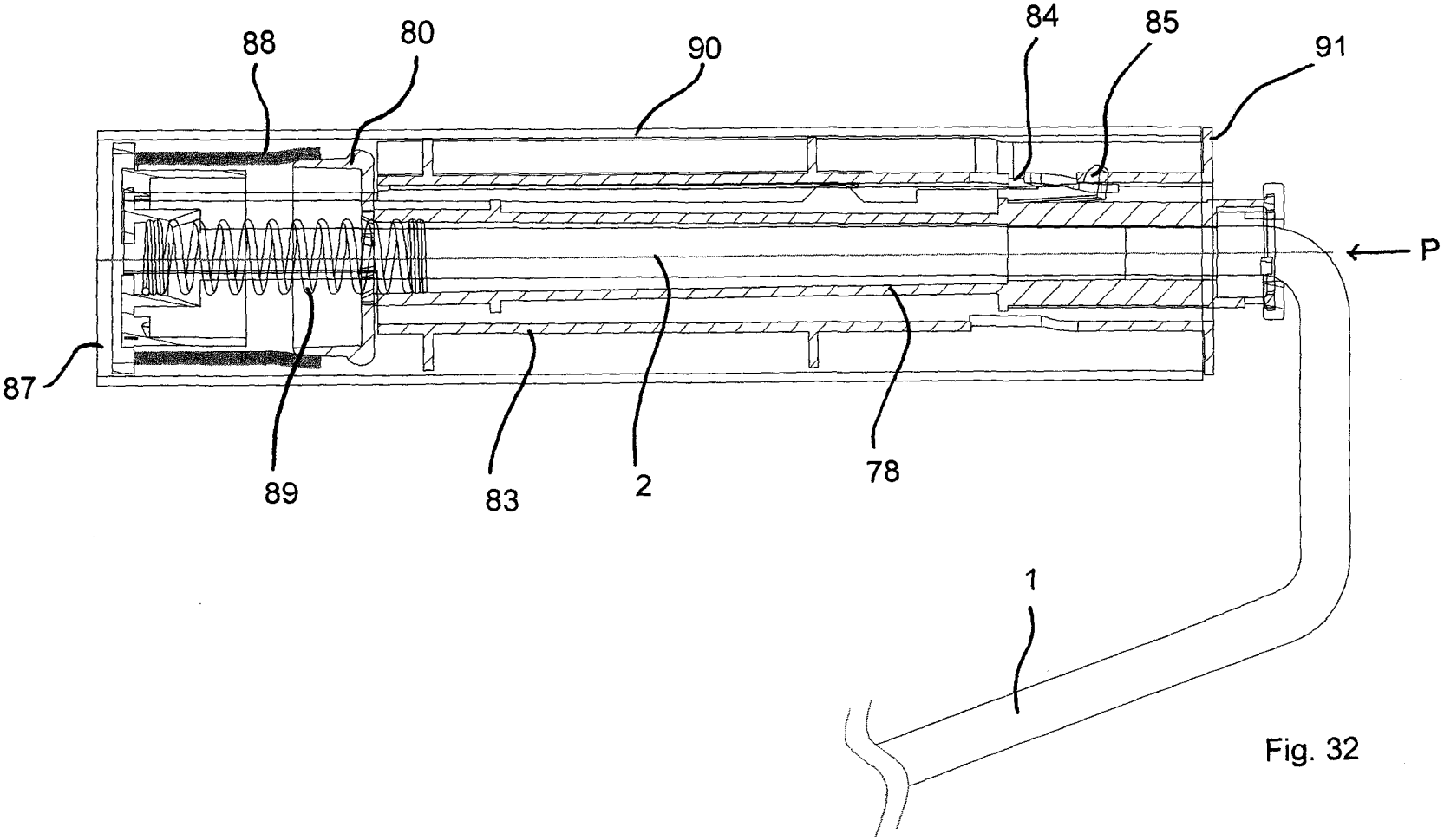
Figure 33:
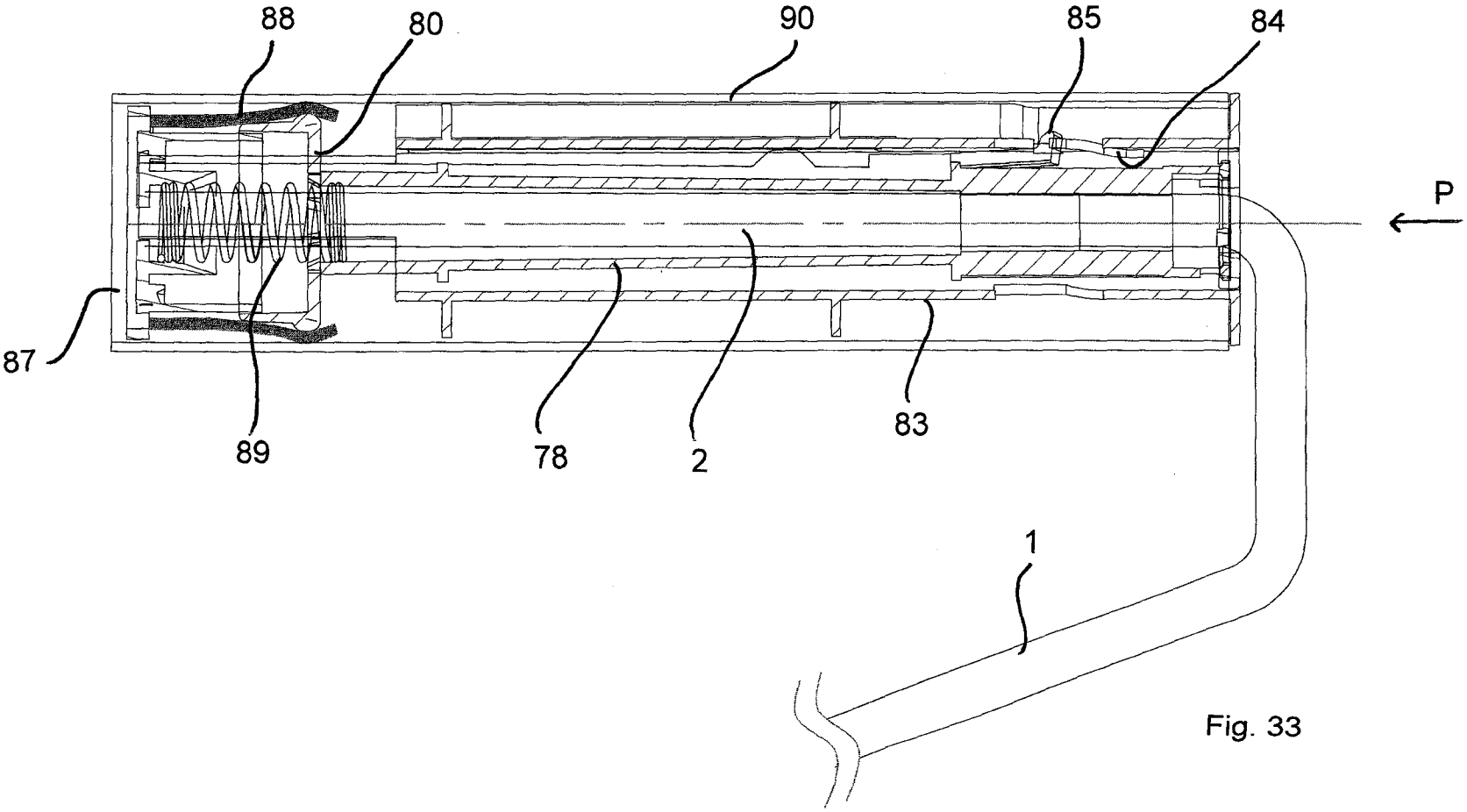
Figure 34:
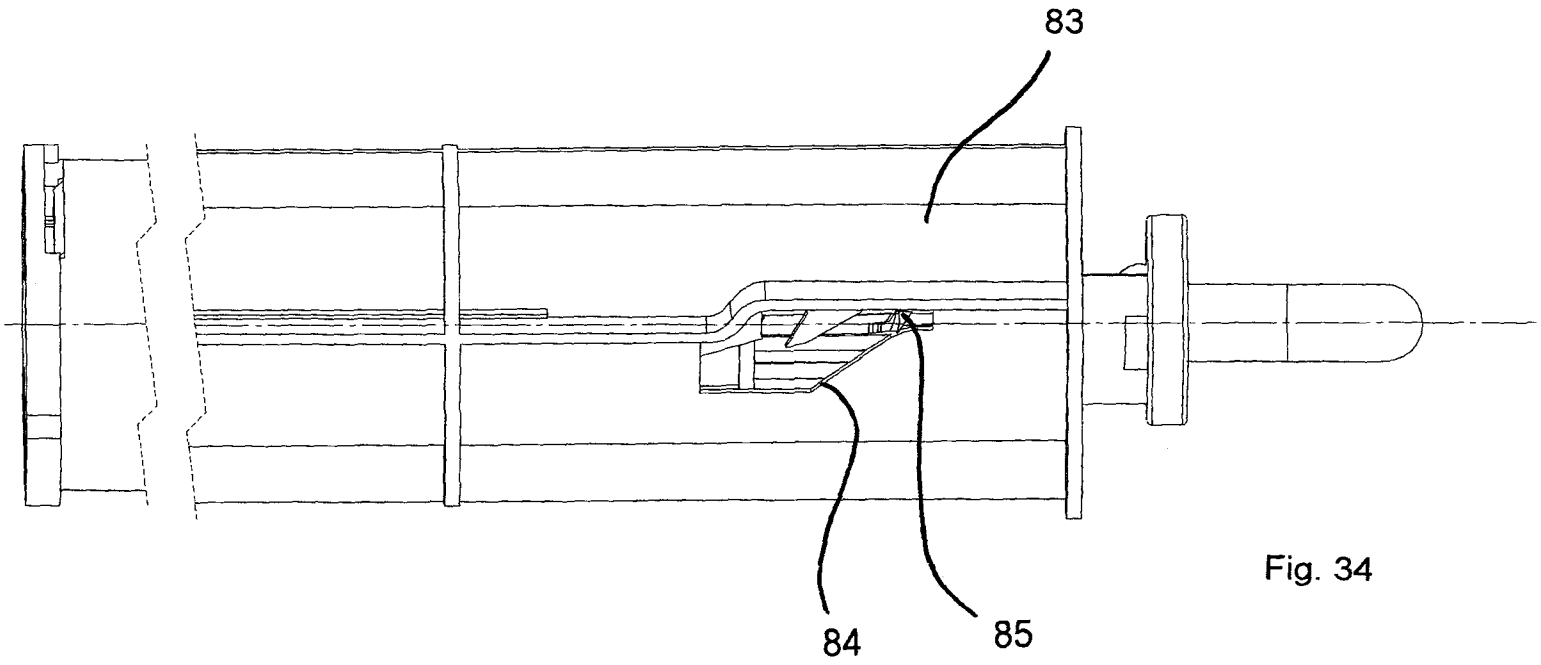

The invention will now be described by way of examples, with reference to the accompanying drawings, in which:

FIG. 1 is a perspective exploded view of a first embodiment,

FIG. 2 is a perspective enlarged view of the first snap element and the first sleeve according to FIG. 1, FIG. 3 is a perspective enlarged view of an end piece according to FIG. 1, FIG. 4 is a side view of the end piece according to FIG. 1, FIG. 5 is a sectional view according to section line A-A in FIG. 4, FIG. 6 is a first perspective view of the end piece according to FIG. 4, FIG. 7 is a second perspective view of the end piece according to FIG. 4, FIG. 8 is a perspective exploded view of a second embodiment, FIG. 9 is a perspective enlarged view of a second snap element, FIG. 10 is a perspective enlarged view of a second counter-snap element, FIG. 11 is a perspective view of the bracket holding the second snap element, FIG. 12 is a perspective enlarged view according to FIG. 11, FIG. 13 is a side view of the second embodiment in an unlocked state, FIG. 14 is a side view of the second embodiment in a locked state, FIG. 15 is a perspective exploded view of a third embodiment, FIG. 16 is a perspective enlarged view of a third snap element and a second sleeve according to FIG. 15, FIG. 17 is a perspective enlarged view of a third counter-snap element according to FIG. 15, FIG. 18 is a sectional view through the paint roller according to the third embodiment, FIG. 19 is a perspective exploded view of a fourth embodiment, FIG. 20 is a perspective enlarged view of a fourth snap element and a third sleeve, FIG. 21 is a perspective enlarged view of a fourth counter-snap element, FIG. 22 is a further perspective enlarged view of the fourth counter-snap element according to FIG. 21, FIG. 23 is a further perspective view of the fourth counter-snap element, FIG. 24 is a further perspective view of the fourth counter-snap element, FIG. 25 is a top view on the fourth counter-snap element, FIG. 26 is a sectional view according to sectional line B-B in FIG. 25, FIG. 27 is a perspective exploded view of a fifth embodiment, FIG. 28 is a perspective enlarged view of a snap arrangement, FIG. 29 is a perspective view of a third end cap, FIG. 30 is a sectional view through the paint roll of a paint roller according to the fifth embodiment, FIG. 31 is a perspective exploded view of a sixth embodiment, FIG. 32 is a sectional view of the sixth embodiment showing the clamping element in a first position, FIG. 33 is a sectional view according to FIG. 32 showing the clamping element in a second position and FIG. 34 is a sectional side view of the sixth embodiment.

With reference to FIGS. 1 to 7 there is shown a first embodiment of the paint roller. The paint roller comprises a bracket 1 which may be provided at its one end E1 with a conventional handle which may be made of plastic (not shown here). The other end E2 is part of a straight end portion 2. The bracket 1 is preferably made of a metal rod.

Reference numeral 3 designates a first paint roll tube which may be provided at its outer circumference with a material which is adapted to hold paint (here not shown). The first paint roll tube 3 can be connected with and disconnected from the bracket 1 by a first push-push mechanism which is now described in detail.

In a first end E3 of the first paint roll tube 3 there is inserted a first end piece 4. In a second end E4 of the first paint roll tube 3 there is inserted a second end piece 5. The first end piece 4 and the second end piece 5 are fixed at the first paint roll tube 3, e.g. by frictional engagement, gluing, welding or the like.

On the end portion 2 of the bracket 1 there is provided a first stop 6. The first stop 6 is made by a deformation of the end portion 2 resulting in two radial protrusions.

Reference numeral 7 designates a first snap element which is rotatably supported on the end portion 2. The first snap element 7 has a central first through hole H1 through which the end portion 2 can be conducted. The first snap element 7 comprises at its outer circumference two elastic snap-tongues 8 each having a radial snap protrusion 9. Each snap protrusion 9 has an inclined edge 9*a*. A slant of the edge 9*a* rises from a radial outer direction to a radial inner direction of the first snap element 7. The elastic snap-tongue 8 is embodied such that the snap protrusion 9 can be flexed in a circumferential direction relative to the first snap element 7 as well as in a radial inner direction of the first snap element 7.

Roughly opposite the snap protrusion 9 there is provided at the snap element 7 a slanted face 9*b* which extends in radial outward direction from a support face 9*c*. A slant of the slanted face runs to an opening which is limited at its one side by the support face 9*c*.

Reference numeral 10 designates an elastic tongue protruding radially inwardly into a first cylindrical section C1 of the first snap element 7. In the first cylindrical portion C1 there is provided a window 11 which allows the insertion of a first sleeve 12. The first sleeve 12 is provided with recesses 12*a* which correspond to the elastic tongue 10. A second cylindrical section C2 has an inner diameter which is smaller than an inner diameter of the first cylindrical section C1. The inner diameter of the second cylindrical section C2 is a little bit larger than an outer diameter of the end portion 2 so that the first snap element 7 can be held rotatably on the end portion 2.

The first snap element 7 further comprises a third cylindrical section C3 an inner diameter of which is chosen such that a compression spring 13 can be held therein by frictional forces. The first cylindrical section C1 and the third cylindrical section C3 are separated by a first flange 14 against which a first spring end E5 abuts. A second spring end E6 abuts against a further flange (not shown here) being provided within the first end piece 4.

At the third cylindrical section C3 there are provided two first radial tongues 15. At the second cylindrical section C2 there are provided second radial tongues 16 which are axially in alignment with the first radial tongues 15.

The first 4 and the second end pieces 5 are formed identically. The end pieces 4, 5 comprise a first counter-snap element 17. The first counter-snap element 17 has guide grooves 18 for guiding therein the first radial tongues 15. Further, there are provided slanted guide rails 19 for guiding the first radial tongues 15 into the guide grooves 18. The first counter-snap element 17 further comprises snap sections 20 having a snap opening 22 where the radial snap protrusions 9 of the elastic snap-tongues 8 are engaged when the first snap element 7 is inserted into the first counter-snap element 17.

At an inner end of the end pieces 4, 5 there are provided funnel-like openings 21 which facilitate the insertion of the other end E2 of the bracket 1. In order to avoid a penetration of paint into the first paint roll tube 3 a second through hole H2 provided in the end pieces 4, 5 can be sealed with an end cap 23.

Although it is not shown there may be provided at the end cap 23 a seal made e.g. of a thermoplastic rubber, silicon, a low density PE or the like. A similar seal may be provided at the inside of a first end flange 16*a* extending from the free end of the second cylindrical section C2 of the snap element 7. The proposed seals hinder paint to penetrate inside the first paint roll tube 3.

FIGS. 4 to 6 show in detail an end piece 4, 5. The end piece 4, 5 comprises the first counter-snap element 17 which has a roughly cylindrical form. At an outer end E7 of the first counter-snap element 17 there is provided a second flange 24 an outer diameter of which is roughly the same like a further outer diameter of the first cylindrical paint roll tube 3. Radial walls 25 extend from the first counter-snap element 17 so as to support the second flange 24. A radial distance between two opposite radial walls 25 is chosen such that the end piece 4, 5 can be held by frictional forces within the first paint roll tube 3.

At an inner end E8 of the first counter-snap element 17 there is provided a third stop 26 against which the compression spring 13 abuts when the first snap element 7 is locked with the first counter-snap element 17. The third stop 26 is embodied here in form of a funnel-like taper.

As can be in particular seen from FIGS. 6 and 7 at an inner wall of the first counter-snap element 17 there are provided slanted guide rails 19 which lead to the guide groove 18.

Two snap sections 20 are provided nearby the opening end E7 of the first counter-snap element 17. Snap sections 20 are arranged opposite to each other. Each snap section 20 comprises a further slanted guide rail 27 leading to the snap opening 22. The further slanted guide rail 27 can be embodied as a slanted guide groove.

The function of the paint roller in accordance with the first embodiment is as follows:

The first snap element 7 abuts against the first stop 6. A second stop is formed by the sleeve 12 which is inserted into a pocket formed within the first cylindrical section C1 of the first snap element 7. The first snap element 7 is held rotatably between the first stop 6 and the sleeve 12.

The elastic tongue 10 cooperates with the recesses 12*a* of the sleeve 12 which is held fixedly on the end portion 2 so that the snap element 7 can be rotated only if a frictional force provided by the action of the elastic tongue 10 is overcome. In the shown embodiment the frictional force changes because of engagement and disengagement of the elastic tongue 10 with the recesses 12*a*. The compression spring 13 is held with its first spring end E5 within the third cylindrical section C3 of the first snap element 7.

In order to lock the bracket 1 supporting thereon rotatably the first snap element 7 the other end E2 of the end section 2 is inserted into the first end piece 4 and then via the funnel-like opening 21 into the second end piece 5. When inserting the first snap element 7 into the first counter-snap element 17 being provided at the first end piece 4 the first radial tongues 15 are guided along the slanted guide rail 19 into the guide grooves 18.

When further inserting the first snap element 7 into the first counter-snap element 17 the elastic snap-tongues 8 are flexed in a first circumferential direction when sliding with their radial snap protrusions 9 on the further slanted guide rails 27 until they come into engagement with a snap opening 22 of the snap section 20.

In the engaged state the compression spring 13 abuts with its first spring end E5 against the flange 14 as well as against the third stop 26 provided within the counter-snap element 17. By the compression spring 13 there is exerted a force urging the first snap element 7 in an axial direction away from the first counter-snap element 17 thereby holding the first snap element 7 in a locked position with respect to the first counter-snap element 17.

In order disconnect the bracket 1 from the first paint roll tube 3 the first snap element 7 is pushed via the bracket 1 against the force of the compression spring 13 in direction of the first counter-snap element 17. Then the radial protrusions 9 are flexed radially inwardly because inclined edges 9*a* of radial snap protrusions 9 slide on a lower edge of the snap opening 22. At the same time each elastic snap tongue 8 slides on the slanted face 9*b* and is flexed in a second circumferential direction, which is opposite to the first circumferential direction, until it abuts at the support face 9*c*. The slanted face 9*b* is formed such that when exerting an axial pressure on the elastic snap-tongues 8 the radial protrusions 9 will not move back to the further slanted guide rail 27. Finally, the elastic snap-tongues 8 are disengaged from the snap opening 22 and are flexed back such that they abut against the inner wall of the counter-snap element 17. The first snap element 7 is forced by the action of the compression spring 13 away from the first counter-snap element 17. Nearby the outer end E7 the radial snap protrusions 9 again enter the further slanted guide rail 27. The first snap element 7 is disconnected and the end portion 2 of the bracket 1 can be drawn out of the first end piece 4.

Once the first snap element 7 is locked with the counter-snap element 17 it cannot be rotated relative to the first counter-snap element 17. I. e. when the first paint roll tube 3 is rotated at the same time the first snap element 7 is rotated. However, by the cooperation of the elastic tongue 10 with the sleeve 12 and the recesses 12*a* provided therein there is caused a frictional force which hinders the rotation of the first paint roll tube 3. This makes it easier to equally provide the first paint roll tube 3 with paint.

In the description of the following embodiments there are used the same reference numerals for similar or identical parts which have already been described in connection with the first embodiment.

FIGS. 8 to 14 show a second embodiment of the invention. In the second embodiment a second push-push mechanism is similar to the first push-push mechanism described with respect to the first embodiment. A second snap element 28 has at its one end a second end flange 29 which is provided with a central breakthrough 30. An inner diameter of the central breakthrough 30 is chosen to be slightly larger than an outer diameter of the end portion 2 of the bracket 1. From an inner end of the second snap element 29 there are extending roughly in axial direction flexible bars or rods 31 which are bent slightly in a radial direction. A second counter-snap element 32 has bars 33 which extend in axial direction. Bars 33 are connected with an end plate 34 which comprises a further central breakthrough 35 through which a third end piece 36 can be inserted.

Similar to the first embodiment on the end portion 2 of the bracket there is provided a first stop 6. The first stop 6 is made by a deformation of the end portion 2 resulting in two radial protrusions. Further, on the end portion 2 there is provided a fourth stop 37 which is produced identical with the first stop 6.

The function of the paint roller in accordance with the second embodiment is as follows:

The function of the second push-push mechanism is more less identical with the function of the first push-push mechanism according to the first embodiment.

However, the second embodiment comprises some further functional features which are now described with reference to FIGS. 13 and 14.

As can be seen from FIG. 13 the second snap element 28 is held rotatably between the first stop 6 and the fourth stop 37. The inner diameter of the central breakthrough 30 is smaller than a distance of the opposite radial protrusions.

When inserting the second snap element 28 into the second counter-snap element 32 rods 31 enter into rod breakthroughs (not shown here in detail) being provided in the end plate 34. A length of the rods 31 is chosen such that upon locking the second snap element 28 with the second counter-snap element 32 rods 31 are bent slightly outwardly in a radial direction. At the same time rods 31 are locked with the third end piece 36 by a further snap mechanism (not shown here in detail). Slightly outwardly bent rods 31 provide an elastic force when inserting the arrangement of the second snap element 28 being locked with the second counter-snap element 32 into a second paint roll tube 38. An inner diameter of the second paint roll tube 38 is chosen slightly larger than an outer diameter of the end plate 34 and the third end piece 36.

FIGS. 15 to 18 show a third embodiment of the invention. On the end portion 2 of the bracket 1 there is held rotatably a third snap element 39 between the first stop 6 which is again made by deformation of the end portion 2 resulting in two radial protrusions, and a second stop which is formed by a second sleeve 40 which is held by frictional forces on the end portion 2.

A third counter-snap element 43 is formed similar to the first counter-snap element 17 described with respect to the first embodiment. It is inserted in a third paint roll tube 44. It is held within the third paint roll tube 44 by frictional forces. The third counter-snap element 43 can also be fixed within the third paint roll tube 44 by gluing, welding or the like. The third counter-snap element 43 has—similar to the first counter-snap element two snap sections 20 being arranged opposite to each other. However, the third snap element 39 is provided here just with one elastic snap-tongue 8.

A third push-push mechanism is similar to the first push-push mechanism described with respect to the first embodiment. Reference is made to the description of the push-push mechanism of the first embodiment.

If a stop is embodied in the form of radial protrusions there may be provided a washer between the radial protrusions and the snap element. The first stop may also be made by a sleeve made of plastic.

FIGS. 19 to 26 show a fourth embodiment of the invention. In the fourth embodiment a fourth push-push mechanism is different from the push-push mechanisms of the first to third embodiments.

A fourth snap element 45 is held rotatably between the first stop 6 and a third sleeve 46 on the straight end portion 2 of the bracket 1 which is provided at its end E1 with a handle 47.

The fourth snap element 45 is roughly formed cylindrically. It comprises at its distal end E9 at least one radially extending snap protrusion 48, preferably two radially extending snap protrusions 48, which are arranged opposite to each other. Each of the snap protrusions 48 has the form of a diamond the acute angles of which are aligned in axial direction.

Reference numeral 49 designates a spring support element having a spring supporting section 50*a* as well as further snap protrusions 50*b*. The spring support element 49 is inserted at the distal end E9 into the fourth snap element 45. It is held at the distal end E9 rotatably by the further snap protrusions 50*b*.

Reference numeral 51 designates a fourth counter-snap element. At an inner surface of the fourth counter-snap element 51 there are provided slanted guide rails 19 (see FIG. 23) which lead to a cam slit 52. The cam slit 52 has a entrance opening 53 and a first end section 54 opposite of which there is located a first slanted guide section 55. In axial direction opposite of an end point of the first slanted guide section 55 there is provided a second slanted guide section 56 leading to a second end section 57. In axial direction opposite to the second end section 57 there is provided a third slanted guide section 58 leading to an exit opening 59. The first 54 and the second end-section 57 have the form of a "V".

The fourth counter-snap element 51 is inserted into a further paint roll tube and fixed there.

The function of the further push-push mechanism is as follows:

The compression spring 13 is held rotatably relative to the third snap element 45 by the spring support element 49. Because of that the fourth snap element 45 is always able to rotate with respect to the fourth counter-snap element 51.

When the fourth snap element 45 enters into the fourth counter-snap element 51 snap protrusions 48 are guided along the slanted guide rails 19 until they enter into the opening 53 of the cam slit 52. Upon further pushing the fourth snap element 45 against the force of the compression spring 13, which abuts against the third stop 26 of the fourth counter-snap element 51, snap protrusions 48 are guided into the first end section 54. At the same time the fourth snap element 45 is rotated in a circumferential direction away from the entrance opening 53. Once having arrived the first end section 54 it is not possible to further push the fourth snap element 45 in axial direction. Pressure is then released and snap protrusions 48 come into contact with the first slanted guide section 55. They are guided along the first slanted guide section 55 to the end point of the first slanted guide section 55, which has the form of a "V", whereby the fourth snap element 45 is again rotated in circumferential direction relative to the fourth counter-snap element 51. The further push-push mechanism is then locked.

Upon exerting again a pressure upon the fourth snap element 45 snap protrusions 48 are guided along the second slanted section 56 to the second end section 57. Upon releasing pressure snap protrusions 48 come into contact with the third slanted section 58 whereby fourth snap element 45 is again rotated in circumferential direction so that the snap protrusions 48 come into axial alignment with the exit openings 59 and fourth snap element 45 can be retracted from the fourth counter-snap element 51.

FIGS. 27 to 30 show a fifth embodiment of the invention. Here, the paint roll comprises a fifth push-push mechanism in which the snap element of the above described push-push mechanisms is embodied as "snap arrangement".

As can be seen from FIGS. 27, 28 and 30 the snap arrangement comprises a first cam tube 60 which is held rotatably on the end portion 2 of the bracket 1 between the first stop 6 and a fourth sleeve 61 which is fixed on the end portion 2, e.g. by frictional forces. As can be seen from FIG. 30 the first stop 6 may comprise a stop sleeve 61*a* which covers radial protrusions being provided at the end portion 2.

A second cam tube 62 is held rotatably at the first cam tube 60 by means of a third flange 63 extending from the outer circumference of the second cam tube 62 which is in engagement with a the circumferential groove 64 provided at the inner surface of the first cam tube 60. The engagement between the third flange 63 and the circumferential groove 64 is such that it is possible for the second cam tube 62 to also move axially within a predetermined distance.

Reference numeral 65 designates a third end piece which is inserted and fixed at the first paint roll tube 3. Reference numeral 13 again designates a compression spring, which abuts against the second cam tube 62 and—in a state where the snap arrangement is in a locked state with the paint roll tube 3—against the third stop 26 which is provided at the third end piece 65.

FIG. 28 shows in detail the snap arrangement. The first cam tube 60 has at its first end face a plurality of first cams 66 which are formed identically. Between each of the first cams 66 there is provided a first groove section 67. Each first cam 66 comprises a first slanted face 68.

The second cam tube 62 has at its second end face second cams 69 which comprise second slanted faces 70 which correspond to the first slanted faces 68. Opposite to the second slanted faces 70 there are provided on the second cams 69 third slanted faces 71. Between two second cams 69 there are provided second groove sections 72.

In FIG. 28 the snap arrangement comprising the first 60 and the second cam tube 62 is shown in an unlocked state where the second groove sections 72 are in alignment with first groove sections 67.

FIG. 29 shows in detail the third end piece 65. At an inner cylindrical surface 73 of the third end piece 65 there are provided axially running tongues 74. Tongues 74 have at its opening end being directed to an opening of the third end piece 65 first slanted guide faces 75 and at its stop a second slanted guide face 76. It has to be noted that the tongues 74 just extend along a predetermined distance at the inner surface 73, said predetermined distance being smaller than the axial length of the cylindrical section forming the inner surface 73. Although it cannot be seen from FIG. 29 there are provided four tongues 74 at the inner surface 73, each of the tongues 74 being displaced by 90° with respect to an adjacent tongue 74. An outer diameter of the first 66 and the second cams 69 is slightly smaller than an inner diameter of the inner surface 73.

The function of the fifth push-push mechanism of the fifth embodiment is as follows:

When inserting the snap arrangement into the third end piece 65 the third slanted faces 71 of the second cams 69 come into contact with first slanted guide faces 75 of the tongues 74. Thereby the second cam tube 62 is rotated so that the second groove sections 72 and thereafter the first groove sections 67 are guided into engagement with the tongues 74, in particular by means of sliding along the first slanted faces 68 or further first slanted faces 68*a*, which also provided at the first cams 66. The second spring end E6 comes into contact with the third stop 26. Compression spring 13 urges the second cam tube 62 against the first cam tube 60 when moving along the tongues 74. As soon as the second groove sections 72 are moved beyond the tongues 74 second cams 69 are rotated by the urging force of the compression spring 13 relative to first cams 66 along the second slanted faces 70. Then the first groove sections 67 and the second groove sections 72 are no longer in alignment.

When releasing the pressure the second guide face 76 of the tongue 74 abuts against a stop face 77 of the second cam 69. Then the snap arrangement is in a locked state.

Upon again exerting a pressure on the snap arrangement the second cam tube 62 is moved inwardly so that the second cams 69 are no longer in engagement with the second guide face 76. Then the second cam tube 62 again rotates relatively to the first cam tube 60 along slanted faces 68 and 70. When releasing the pressure the second slanted faces 70 come again into contact with the second guide faces 76 of the tongues 74. This causes a further rotational movement of the second cam tube 62 until the first groove section 67 and the second groove section 72 come into alignment so that the snap arrangement can be retracted from the third end piece 65.

FIGS. 31 to 34 show a sixth embodiment of the invention. A sixth push-push mechanism comprises a fifth snap element 78 being provided at its one end with a ring disk 79 which is made of an elastic material. The fifth snap element 78 which has a substantially tubular shape is provided at its other or free end with a piston like actuating element 80 having a conical form. The actuating element 80 may have a radial extending bead 81. The actuating element 80 further comprises breakthroughs 82.

Reference numeral 83 designates a fifth counter-snap element having a substantially tubular shape. As can in particular be seen from FIG. 34 the fifth counter-snap element 83 has a further breakthrough 84 through which second elastic snap-tongues 85 which are extending radially from the fifth snap element 78 extend. Mounting tongues 86 extend from one end of the fifth counter-snap element 83. Mounting tongues 86 extend—in an assembled stage—through breakthroughs 82 into the second end cap 87. Second end cap 87 is held by mounting tongues 86 fixedly with respect to the fifth counter-snap element 83. Reference numeral 88 designates a flexible hose which is fixed at the second end cap 87.

In the assembled stage the fifth snap element 78 is rotatably held upon the end portion by the ring-disk 79 which is pressed beyond end portion 2. The fifth counter-snap element 83 is held upon the fifth snap element 78 because of the engagement of the second elastic snap-tongues 85 with the second breakthroughs 84 and because of the fact that mounting tongues 86 extend through the further breakthroughs 82 being provided at the actuating element 80. Therewith the fifth snap element 78 is held with respect to the fifth counter-snap element 83 in a rotatably fixed manner. As can be seen in particular from FIGS. 32 and 33 there is provided between the second end cap 87 and the actuating element 80 a further compression spring 89 which urges the fifth snap element 78 in a direction away from the second end cap 87. The second end cap 87 is fixedly connected with the fifth counter-snap element 83 by the mounting tongues 86. The fifth snap element 78 can be moved axially against the force of the further compression spring 89 along an axial length of the further breakthrough 84. The whole sixth push-push mechanism formed by the aforementioned parts is provided at the end portion 2 of the bracket 1. —A fifth paint roll tube is designated with reference numeral 90.

The function of the paint roller according to the sixth embodiment is as follows:

In order to fix the fifth paint roll tube 90 the sixth push-push mechanism being provided on the bracket 1 is in a first state which is shown in FIG. 32. In the first state the actuating element 80 is forced by the further compression spring 89 in a distal position with respect to the second end cap 87. Then the sixth push-push mechanism is inserted into the fifth paint roll tube go until a fourth flange 91 extending from the fifth counter-snap element 83 abuts against the fifth paint roll tube 90. Upon exerting a pressure in an axial direction of the end portion 2 towards the second end cap 87 the fifth snap element 78 is moved axially against the force of the further compression spring 89 in direction of the second end cap 87 until the second elastic snap-tongues 85 come into engagement with a stop position in the breakthroughs 84. The sixth push-push mechanism by which the second elastic snap-tongues 85 are moved from the first into the second position and are releasable fixed in said positions is embodied similar to the first push-push mechanism. However, there are not provided guide grooves allowing a release of the fifth snap element 78 from the fifth counter-snap element 83.

As can be seen from a comparison of FIGS. 32 and 33 in a second position the actuating element 80 is in a position where the flexible hose 88 is urged in a radial direction thereby clamping the fifth paint roll 90. Upon again exerting a pressure P in axial direction of the end portion 2 towards the second end cap 87 the second elastic snap-tongues 85 are released and the fifth snap element 78 is pushed by the action of the further compression spring 89 in a direction away from the second end cap 87. An outer radius of the flexible hose 88 becomes smaller so that the fifth paint roll tube 90 can be disengaged from the bracket 1 supporting the sixth push-push mechanism.

Although the enclosed figures show a specific embodiments of push-push mechanisms which allow a connection and a disconnection of a bracket with a paint roll tube it has to be understood that the push-push mechanism can also be realized by other constructions.

Although it is not shown in the enclosed figures it may be possible that the counter-snap element and the paint roll tube may be formed in one single piece.

LIST OF REFERENCE SIGNS

1 bracket
2 end portion
3 first paint roll tube
4 first end piece
5 second end piece
6 first stop
7 first snap element
8 elastic snap-tongue
9 radial snap protrusion
9*a* inclined edge
9*b* slanted face
9*c* support face
10 elastic tongue
11 window
12 first sleeve
12*a* recess
13 compression spring
14 first flange
15 first radial tongue
16 second radial tongue
16*a* first end flange
17 first counter-snap element
18 guide groove
19 slanted guide rail
20 snap section
21 funnel-like opening
22 snap opening
23 end cap
24 second flange
25 radial wall
26 third stop
27 further slanted guide rail
28 second snap element
29 second end flange
30 central breakthrough
31 rod
32 second counter-snap element
33 bar
34 end plate
35 further central breakthrough
36 third end piece
37 fourth stop
38 second paint roll tube
39 third snap element
40 second sleeve
41 cam
42 further elastic tongue
43 third counter-snap element
44 third paint roll tube
45 fourth snap element
46 third sleeve
47 handle
48 snap protrusion
49 spring support element
50*a* spring support section
50*b* further snap protrusions
51 fourth counter-snap element
52 cam slit
53 entrance opening
54 first end section
55 first slanted guide section
56 second slanted guide section
57 second end section
58 third slanted guide section
59 exit opening
60 first cam tube
61 fourth sleeve
61*a* stop sleeve
62 second cam tube
63 third flange
64 circumferential groove
65 third end piece
66 first cam
67 first groove section
68 first slanted face
68*a* further first slanted face
69 second cam
70 second slanted face
71 third slanted face
72 second groove section
73 inner cylindrical surface
74 tongue
75 first guide face
76 second guide face
77 stop face
78 fifth snap element
79 ring disk
80 actuating element
81 bead
82 breakthrough
83 fifth counter-snap element
84 further breakthrough
85 second elastic snap-tongue
86 mounting tongue
87 second end cap
88 flexible hose
89 further spring
90 fifth paint roll tube
91 fourth flange
C1 first cylindrical section
C2 second cylindrical section
C3 third cylindrical section E1 end
E2 another end
E3 first end
E4 second end
E5 first spring end
E6 second spring end
E7 outer end
E8 inner end
E9 distal end
H1 first through hole
H2 second through hole
P pressure

The invention claimed is:

1. Paint roller comprising a paint roll and bracket having at its one end a handle and on its other end an end portion where the paint roll can be connected rotatably, wherein a push-push mechanism is provided by which the bracket and the paint roll can be connected and disconnected, wherein the push-push mechanism is embodied such that the connection and the disconnection is achieved by pushing the bracket in a pushing direction which is parallel to an extension direction of the end portion and which is directed towards a free end of the paint roll, the free end being the end opposite to another end in which the end portion of the bracket is inserted.

2. Paint roller according to claim 1, wherein at the end portion there is provided a snap element, wherein a counter-snap element, which corresponds to the snap element, is provided at a first end of a paint roll tube of the paint roll, wherein a spring member for producing an elastic force urging the snap element and the counter-snap element apart when moving the snap element in direction of the counter-snap element are provided, and wherein the spring member, the snap element and the counter-snap element act together such that the snap element engages with the counter-snap element when pushing the snap element against the elastic force in direction of the counter-snap element, and the snap element disengages from the counter-snap element when subsequently pushing the snap element against the elastic force in direction of the counter-snap element so that the paint roll can be disconnected from the bracket.

3. Paint roller according to claim 2, wherein the snap element is supported rotatable on the bracket between a first stop and a second stop limiting an axial movement of the snap element.

4. Paint roller according to claim 2, wherein the elastic force exerted by the spring member upon the snap element and the counter-snap element holds the snap element in an engaged position with respect to the counter-snap element.

5. Paint roller according to claim 2, wherein the snap element and the counter-snap element are formed such that they cannot be rotated against each other in the engaged state.

6. Paint roller according to claim 2, wherein the counter-snap element is part of a first end piece being inserted into a first end of the paint roll tube.

7. Paint roller according to claim 1, wherein at the end portion there is provided a snap arrangement comprising a first and a second cam tube being supported rotatable on the bracket, the first cam tube having at its first end face a plurality of first cams, the first cam tube being supported on the bracket between two stops limiting an axial movement thereof, the second cam tube being rotatably engaged with the first cam tube and having at a second end face a plurality of second cams which are engageable with the first cams and which can be rotated with respect to the first cams in a lock position and in an unlock position, wherein in the unlock position there are formed axial grooves running between the cams, said grooves corresponding to axially running tongues being provided at an inner surface at a paint roll tube so that the snap arrangement being in the unlock position can be inserted into the paint roll tube, wherein at the paint roll tube there is provided a third stop, and wherein a spring member for producing an elastic force urging the second cams against the first cams when moving the snap arrangement against the third stop are provided.

8. Paint roller according to claim 7, wherein the first cams have first slanted faces and the second cams have corresponding second slanted faces so that the second cam tube rotates into the lock position when the second cam tube is urged by the spring member against the first cam tube and when the second cam tube is out of engagement with the tongues.

9. Paint roller according to claim 7, wherein the inner surface, the tongues and the third stop are part of a third end piece being inserted into a first end of the paint roll tube.

10. Paint roller according to claim 1, wherein a first stop is a radial protrusion being formed at the bracket.

11. Paint roller according to claim 1, wherein a stop is made of a sleeve being fixed on the bracket.

12. Paint roller according to claim 11, wherein the sleeve is provided at its surface with several recesses and wherein a snap element is provided with an elastic tongue engaging and disengaging with the recesses when the snap element is rotated around the sleeve.

13. Paint roller according to claim 1, wherein a spring member is supported at the bracket.

14. Paint roller according to claim 1, wherein a spring member is a compression spring.

15. Paint roller according to claim 1, wherein a second end piece is inserted into a second end of a paint roll tube.

16. Paint roller according to claim 1, wherein an end cap sealing a through hole is provided at a second end piece.

17. Paint roller according to claim 1, wherein a first and a second end piece are constructed identically.

18. Paint roller according to claim 1, wherein the push-push mechanism comprises a snap element being provided at the end portion, a counter-snap element being in engagement with the snap element such that upon pushing the bracket in the pushing direction the snap element is moved relative to the counter-snap element in an axial direction from a first axial position into a second axial position or vice-versa, and a clamping device having a clamping element being actuated by the snap element such that it changes its radius in dependency of the position of the snap element.

19. Paint roller according to claim 18, wherein the snap element is held rotatably upon the end portion.

20. Paint roller according to claim 18, wherein the counter-snap element comprises an end cap, and wherein a compression spring is provided between the end cap and an actuating element being provided at a free end of the snap element.

21. Paint roller according to claim 1, wherein a clamping element is a flexible hose extending from the end cap and surrounding an actuating element, wherein the actuating element has a conical shape such that a radius of the flexible hose is changed in dependency of the position of the actuating element.

22. Paint roller according to claim 1, wherein a first outer radius of a clamping element corresponding to the first position of an actuating element is smaller than an inner radius of a paint roll tube, and wherein a second outer radius of the clamping element corresponding to the second position of the actuating element is larger than the inner radius of the paint roll tube.

* * * * *